US007888872B2

(12) United States Patent
Maree et al.

(10) Patent No.: US 7,888,872 B2
(45) Date of Patent: Feb. 15, 2011

(54) ELECTRIC LAMP

(75) Inventors: Chrysostomus Hidde Maria Maree, Eindhoven (NL); Jiajun Wang, Maarheeze (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 515 days.

(21) Appl. No.: 11/575,769

(22) PCT Filed: Aug. 19, 2005

(86) PCT No.: PCT/IB2005/052731

§ 371 (c)(1),
(2), (4) Date: Mar. 22, 2007

(87) PCT Pub. No.: WO2006/035327

PCT Pub. Date: Apr. 6, 2006

(65) Prior Publication Data

US 2009/0179570 A1 Jul. 16, 2009

(30) Foreign Application Priority Data

Sep. 30, 2004 (EP) ..... 04104790

(51) Int. Cl.
*H01J 17/18* (2006.01)

(52) U.S. Cl. ..... 313/623

(58) Field of Classification Search ..... 313/623–626; 445/26–27

See application file for complete search history.

(56) References Cited

U.S. PATENT DOCUMENTS 3,753,026 A 8/1973 Goorissen
3,848,151 A 11/1974 McVey
4,254,300 A 3/1981 Thompson-Russell
4,559,278 A 12/1985 Nagy et al.
4,755,712 A * 7/1988 Mujahid et al. ..... 313/331
5,021,711 A * 6/1991 Madden et al. ..... 313/623
5,109,181 A 4/1992 Fischer et al.
5,158,709 A * 10/1992 Setti ..... 252/512
5,497,049 A 3/1996 Fischer
5,606,141 A 2/1997 Leichtfried (Continued)

FOREIGN PATENT DOCUMENTS

DE 19603300 A1 7/1997

(Continued)

OTHER PUBLICATIONS

Klopp W. and Witzke W., "Mechanical Properties of Electron-Beam-Melted Molybdenum and Dilute Molybdenum-Rhenium Alloys", Jun. 1972, NASA TM X-2576 (Technical Memorandum), National Aeronautics and Space Administration.*

(Continued)

*Primary Examiner*—Toan Ton
*Assistant Examiner*—Hana S Featherly

(57) ABSTRACT

An electric lamp includes a quartz-glass envelope having at least one sealed end, a thin foil including molybdenum at least partly embedded within said sealed end, a first current conductor connected to the foil extending interiorly of the envelope, and a second current conductor connected to the foil and extending exteriorly of the envelope. The re-crystallized foil exhibits a yield strength (offset=0.2%) according to ASTM F 8M-91 below 300 MPa. This can be obtained by molybdenum doped with between 0.01 and 5 wt % of rhenium or 0.01 and 2 wt % of tungsten.

10 Claims, 1 Drawing Sheet

U.S. PATENT DOCUMENTS

Figure 1:
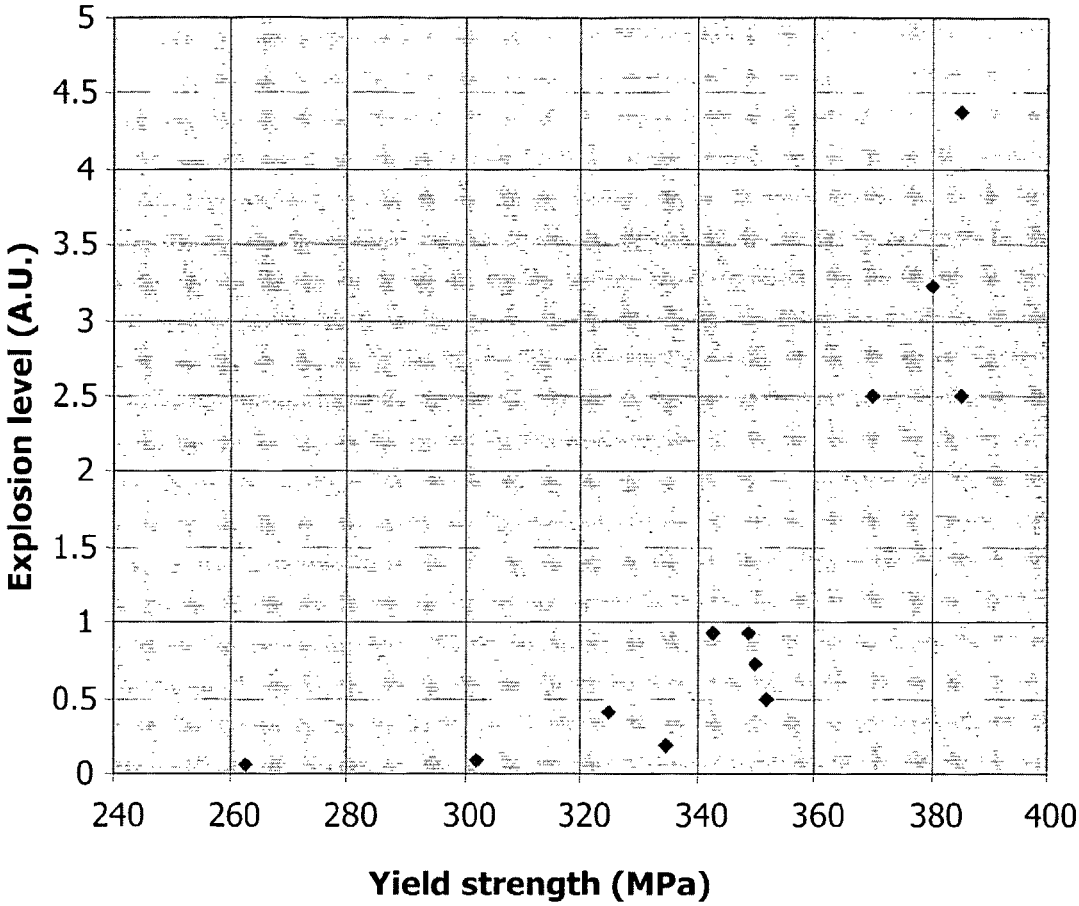

| | | | | |
|---|---|---|---|---|
| 5,986,403 | A * | 11/1999 | Jansen et al. | 313/623 |
| 6,359,386 | B1 | 3/2002 | Von Morgen et al. | |
| 6,753,650 | B2 * | 6/2004 | Leichtfried et al. | 313/623 |
| 2003/0094899 | A1 | 5/2003 | Fukushima et al. | |
| 2004/0244879 | A1 * | 12/2004 | Tanaka et al. | 148/514 |

FOREIGN PATENT DOCUMENTS

| | | | |
|---|---|---|---|
| EP | 275580 | A1 | 7/1988 |
| EP | 0495588 | A2 * | 1/1992 |
| EP | 0495588 | A2 | 7/1992 |
| EP | 0512632 | A1 | 11/1992 |
| EP | 0581354 | * | 4/1998 |
| EP | 871202 | A2 | 10/1998 |
| GB | 1313531 | | 4/1973 |
| JP | 59080746 | A * | 5/1984 |
| SU | 702427 | A | 12/1972 |

OTHER PUBLICATIONS

"Electrode Subassembly for Vacuum Lamps, " -& SU 702 427 A Database WPI Section CH, Week 198031, Derwent Publicaton Ltd., London, AN 1980-54897C, XP002355905, ((Baik) Baikov Metallurgy Inst) Dec. 10, 1979.

A.J. Mueller et al; "Evaluation of Oxide Dispersion Strengthened (ODS) Molybdenum and Molybdenum-Rheniuim Alloys", International Journal of Refractory Metals & Hard Materials, vol. 18, 2000, pp. 205-211.

* cited by examiner

ELECTRIC LAMP

The invention relates to an electric lamp comprising a quartz-glass envelope having at least one sealed end, a thin foil comprising molybdenum at least partly embedded within said sealed end, a first current conductor connected to said foil extending interiorly of said envelope, and a second current conductor connected to said foil extending exteriorly of said envelope.

In lamps having an envelope of a quartz-glass, i.e. glass having a $SiO_2$ content of at least 95% by weight, a molybdenum foil is frequently used as a current lead-through conductor. In spite of the considerably different coefficients of thermal expansion of the quartz-glass (approximately $7\times10^{-7}$ per deg. C.) and of molybdenum ($54\times10^{-7}$ per deg. C.) lamps having vacuum-tight seals are nevertheless obtained. This is due to the ductility of molybdenum, to the shape of the foil, knife edges of the foil extending in the longitudinal direction of the seal, and to the small thickness of the foil, which is a few tens of μm.

The material and shape of the current lead-through conductor or current feeder of electrical lamps having a glass bulb quite substantially determine the manufacture, function and quality of such lamps. The term "lamps" especially comprises halogen filament lamps and discharge lamps such as mercury vapour high-pressure lamps, halogen-metal vapour lamps, and xenon-HP-discharge lamps.

Much attention has been paid in the past to this technical field. Electrical conductors for feeding current in lamps with or without gas filling are, as a rule, fused in quartz glass or squeezed into the latter, depending on the pressure in the lamp. This results in a collapsed seal, respectively a pinched seal. Molybdenum, owing to its high melting point and its favourable coefficient of thermal expansion as compared to quartz-glass, has been found to be a suitable conductor material for feeding current.

Other material requirements a molybdenum conductor is expected to satisfy are ductility, good mouldability, weldability, and optimised mechanical strength, resistance to oxidation and/or corrosion, especially against halides, and fusibility with the current conductors.

In order to achieve a vacuum-tight sealing of the molybdenum foil in the glass despite the very different coefficients of thermal expansion in particular of silica glass or glass materials with a high $SiO_2$ content and molybdenum, the foil is configured to be very thin (typically 15 to 50 μm), with a high width-to-thickness ratio (typically >50), and has side edges which taper in the form of a cutting blade.

The current conductors, which are significantly thicker than the foil, have to be welded onto this thin molybdenum foil. The first current conductor is in many cases formed of tungsten. Particularly with current conductors made of tungsten, this entails very high welding temperatures, which may result in embrittlement and consequently a fracturing of the molybdenum foil. Cracks in the foil can also occur during the sealing process. Such cracks may be caused by the relative movement between the glass and the foil or by a build-up of tensile stresses during the cooling process, at temperatures which are below the stress relaxation temperature of the glass.

In order to improve the mechanical strength of the molybdenum foil, doped molybdenum alloys have been used instead of pure molybdenum.

According to U.S. Pat. No. 4,254,300 small quantities of yttrium oxide considerably increase the strength of the foil both before and after welding operations have been performed, as well as the force which has to be exerted on a weld to break it. Before being pinched in the lamp envelope, the foil according to the invention with the current conductors welded thereto may be heated, if desired, in a reducing atmosphere, up to temperatures of approximately 1300° C. without losing mechanical strength of the current lead-through conductor.

In U.S. Pat. No. 4,559,278 an intermediate metal coating is applied onto the current lead-through conductor in order to ensure high weldability and hermetic sealing with the vitreous material used around the current lead-through conductor. The basic metal of the current lead-through conductor is molybdenum, the whole surface of which or the surface part which is to be welded, is covered with an intermediate metal coating made of rhenium.

According to EP-A-0 275 580, it is proposed to manufacture current lead-through conductors for lamps from molybdenum, doped with 0.01 to 2% by weight yttrium oxide, and 0.01 to 0.8% by weight molybdenum boride. This dope was intended as an improvement over potassium-silicon-doped molybdenum; however, it does not offer any improvements, especially not with respect to the resistance to oxidation. A serious drawback of this material is that it frequently causes socket cracks in the glass within the zone where it is fused or squeezed in, such cracking being caused by changes in the strength of the material in the course of recrystallization of the latter in the fusing step.

A doped molybdenum used for current lead-through conductors in lamps is further known from AT-B 395 493, wherein the dope consists of 0.01 to 5% by weight of one or several oxides of the lanthanides, the balance being Mo.

In U.S. Pat. No. 5,606,141 it is recognized that cracking in the pinched zone is frequently caused by changes in the strength of the material in the course of recrystallization in the fusing step and that this problem can be solved by incorporating an electrical conductor made of etched strip material based on molybdenum-yttrium oxide as current feeder in lamps with a metal/glass sealing. In addition to Mo—$Y_2O_3$, the strip material contains up to 1.0% by weight cerium oxide, whereby the cerium oxide:yttrium oxide ratio amounts to 0.1 to 1.

German Patent Application No. DE-A-196 03 300 describes a molybdenum foil which is doped with 0.01 to 1% by weight of alkali-rich and alkaline earth-rich silicates and/or aluminates and/or borates of one or more elements selected from groups IIIb and/or IVb of the periodic system. This doping prevents the formation of cracks in the pinch seal, caused by the high mechanical stresses in the molybdenum/quartz glass composite. However, this does not improve foil adhesion compared to foils which are doped with $Y_2O_3$ mixed oxide or Y mixed oxide.

Moreover, it has also been attempted to improve the $SiO_2$/Mo adhesion by roughening the foil for example by sand blasting, as described in Published European Patent Application No. EP-A-0 871 202. However, this process is highly complex and leads to internal stresses being introduced in the molybdenum foil.

U.S. Pat. No. 6,753,650 describes a method which includes a post-treating of the unfinished foil such that substantially non-contiguous, insular regions of material agglomerates are formed. The material agglomerates are formed of molybdenum, molybdenum alloys, titanium, silicon, an oxide, a mixed oxide and/or an oxide comprising compound, with a vapour pressure of less than 10 mbar at 2000° C. in each case. The substantially non-contiguous, insular regions are formed on at least 5 percent and at most 60 percent of the area of the foil surface. In this way, the adhesive strength between the foil and the glass and therefore also the service life of the lamp are improved significantly.

However, an important limitation of the present electric lamps and in particular of UHP lamps is the maximum pressure that can be obtained in a burner. Higher pressures in the burner are important to improve the lumen output. A limitation of the maximum pressure, however, is caused by increased sensitivity to explosion.

The invention has for its object to provide a lamp of the kind mentioned in the opening paragraph, which has not only a high luminance and a satisfactory light output, but also low sensitivity to explosion.

According to the invention a lamp of the kind as defined in the opening paragraph for this purpose has the characterizing features of claim 1.

By the application of a re-crystallized foil with a yield stress below 300 MPa, higher operating pressures in the bulb of the lamp can be achieved, without significant increase of the sensitivity to explosion. Lamps of the invention, with similar internal pressure to existing lamps, exhibit substantially lower sensitivity to explosion.

In the lamp of the invention the re-crystallized molybdenum foil exhibits a yield strength at 0.2% below 300 MPa. It has been recognized by the inventors, that the sensitivity to explosion is related to the yield strength of the molybdenum foil after re-crystallization, which occurs in the sealing step. The addition of metals and metal oxides, applied in the state of the art lamps described above, all lead to an increase of the yield strength of molybdenum.

In the present invention the yield strength is defined as a yield strength at an offset of 0.2% to ASTM E 8M-91, chapter 7.4.1.

A significant decrease of the yield strength of a re-crystallized foil is preferably obtained in a foil comprising molybdenum doped with between 0.01 and 5 wt % of rhenium or between 0.01 and 2 wt % of tungsten. Above 0.01 wt % of rhenium or tungsten, the effect of a decrease of the yield strength is enough to obtain decreased sensitivity to explosion. Above 5, or 2 wt % of rhenium or tungsten respectively, the yield strength exceeds the yield strength of molybdenum, which is commercially used in lamps. Therefore, the yield strength of a typical molybdenum-rhenium alloy, which comprises about 26 at eq. % of rhenium, and which is for example applied in a pinch seal in a metal-halogen lamp described in GB 1,313,531, is far above the yield strength of lamps according to the invention. It has been found by the inventor that by increasing the amount of rhenium or tungsten dope, the yield strength of the thus formed doped and re-crystallized molybdenum goes through a minimum value. Therefore the amount of the rhenium dope in the molybdenum is preferably between 0.02 and 2 wt % with more preference between 0.05 and 1.0 wt %, and the amount of the tungsten dope in the molybdenum is preferably between 0.02 and 1 wt %, with more preference between 0.05 and 0.5 wt %.

A further advantage of molybdenum comprising a dope of between 0.01 and 5 wt % of rhenium is a significantly improved resistance against corrosion to a metal vapour, especially to a metal halide gas. This improved resistance however is also obtained in molybdenum comprising dopes between 0.01 and 0.1 wt. % of Ce, Ti, or between 0.01 and 1 wt % of Al, Co, Fe, Hf, Ir, or Y, or between 0.01 and 5 wt % of Cr.

As is usual in lamps having molybdenum foils in pinched or collapsed seals, the thickness of molybdenum foils which are used in lamps according to the invention depends on the kind of lamp, and is between approximately 15 and approximately 80 μm, preferably between 25 and 50 μm. Within these ranges the best balance between strength and yield performance of the foil is obtained. In order to avoid the existence of a capillary passage on either side of the foil in the longitudinal direction of the seal, the molybdenum foil, as is usual in the art, is etched so that knife edges are formed so that the quartz-glass of the seal readily embraces the foil.

The doped molybdenum used in the lamp of the invention can be prepared by methods for doping of metals well known in the field.

Improved welding properties can be obtained when the molybdenum further comprises dopes of up to 1 wt % of one or several of the following oxides: $Y_2O_3$, $SiO_2$, $HfO_2$, $ZrO_2$, $TiO_2$, $Al_2O_3$, or an oxide of one of the lanthanides. An advantage of the present invention is that the increased yield strength caused by the addition of these oxides to pure molybdenum can be more than compensated by a dope of rhenium or tungsten.

The invention will be elucidated with some examples.

EXAMPLE I

Molybdenum foils, comprising different dopes were prepared according to known mixing and sintering methods. The foils were recrystallized at 2000° C. for 10 minutes in hydrogen. The yield strength of these foils was measured according to ASTM E 8M-91 chapter 7.4.1. Results are given in Table 1.

TABLE 1

| Material | Yield strength MPa |
|---|---|
| Molybdenum | 313 |
| 0.3 wt % $Y_2O_3$ doped Mo | 330 |
| 0.6 wt % $Y_2O_3$ doped Mo | 353 |
| 0.9 wt % Re + 0.3 wt % $Y_2O_3$ doped Mo | 263 |

While the addition of Y2O3 increases the yield strength of Mo, addition of 0.9 wt % rhenium significantly lowers the yield strength of Mo doped with $Y_2O_3$.

EXAMPLE II

Foils of the materials mentioned in table 1, were mounted under different collapsed sealing (and thus re-crystallization) conditions in UHP lamps, which were burned at 150 W during 8 hours. The relative level of exploded lamps is shown in FIG. 1, versus the yield strength of the respective doped foils. FIG. 1 clearly shows that lamps, exhibiting a yield strength below 300 MPa have a much lower explosion level than existing lamps with a yield strength above 300 MPa. As the relative explosion level is directly related to the service life of the lamps, it can also be concluded that lamps according to the invention have a longer service life.

FIG. 1 also shows that for materials with a yield strength above 300 MPa, the explosion level strongly depends on the yield strength and thus on the sealing conditions A further advantage of the present invention is that the explosion level, or service life hardly depends on the sealing conditions. A lamp according to the invention not only has longer service life, but its service life can be better predicted. The lamp of the invention preferably comprises a re-crystallized foil that exhibits a yield strength (offset=0.2%) according to ASTM E 8M-91 below 290 MPa, with more preference below 275 MPa.

EXAMPLE III

Foils with a thickness of 80 μm were put into a furnace in an air atmosphere. The samples were heated up to 600° C. and held for 12 hours. The weights of the samples were measured and relative weight changes were calculated by considering the original weight of the samples. The results are given in table 2.

TABLE 2

| Samples | Pure Mo | 0.6 wt % Y2O3 doped Mo | 0.9 wt % Re + 0.3 wt % Y2O3 doped Mo |
|---|---|---|---|
| Weight gain in % | 49.7% | 48.1% | 15.5% |

EXAMPLE IV

Foils with different dopes were used to make Masterline ES type lamps. These lamps are filled with metal halide salts. The lamps to be tested were put in a furnace with a temperature of 475° C. The lamp life was determined when cracking occurred in the pinched seal due to corrosion.

Results are given in table 3.

TABLE 3

| | Ref. lamps with 0.5 wt % $Y_2O_3$ + 0.1 wt % $Ce_2O_3$ doped Mo | Lamps with 0.9 wt % Re + 0.3 wt % $Y_2O_3$ doped Mo |
|---|---|---|
| Lamp life (hr) | 66 | 229 |

EXAMPLE V

Foils with different dopes were used to make Xenon Headlights. The lamps were put in a furnace with a temperature of 1030° C. and corrosion damage degrees were visually evaluated. The degree of damage of a lamp with a Ref. foil (0.5 wt % $Y_2O_3$+0.1 wt % $Ce_2O_3$ doped Mo) was significantly higher than a lamp comprising a molybdenum foil with a dope of 0.9 wt % Re+0.3 wt % of $Y_2O_3$.

These results clearly show that molybdenum doped with less than 1 wt % of Re has a higher oxidation and corrosion resistance.

The invention claimed is:

1. A lamp comprising:

a quartz-glass envelope having at least one sealed end, a foil comprising molybdenum at least partly embedded within said sealed end, a first current conductor connected to said foil extending interiorly of said envelope, and a second current conductor connected to said foil and extending exteriorly of said envelope, wherein the foil after being re-crystallized exhibits a yield strength (offset=0.2%) according to ASTM E 8M-91 below 300 MPa, and wherein the foil comprises molybdenum doped with between 0.01 and 4 wt % of rhenium.

2. The lamp according to claim 1, wherein the foil comprises molybdenum doped with between 0.01 and 2 wt % of tungsten.

3. The lamp according to claim 1, wherein the molybdenum also comprises a dope of up to 1 wt % of one or several of the following oxides: $Y_2O_3$, $SiO_2$, $HfO_2$, $ZrO_2$, $TiO_2$, $Al_2O_3$, or an oxide of one of the lanthanides.

4. The lamp of claim 1, wherein the foil comprises molybdenum doped with between 0.02 and 2 wt % of rhenium.

5. The lamp of claim 1, wherein the foil comprises molybdenum doped with between 0.05 and 1.0 wt % of rhenium.

6. A lamp comprising a quartz-glass envelope having at least one sealed end, a thin foil comprising molybdenum at least partly embedded within said sealed end, a first current conductor connected to said foil extending interiorly of said envelope, and a second current conductor connected to said foil and extending exteriorly of said envelope, wherein the foil comprises molybdenum doped with between 0.01 and 4 wt % of rhenium and further doped with either 0.01 and 1 wt % of Co, Fe, and/or Ir, or with between 0.01 and 5 wt % of Cr.

7. The lamp of claim 6, wherein the foil comprises molybdenum doped with between 0.02 and 2 wt % of rhenium.

8. The lamp of claim 6, wherein the foil comprises molybdenum doped with between 0.05 and 1.0 wt % of rhenium.

9. A lamp comprising:

an envelope having a sealed end;

a foil at least partly embedded within the sealed end; and conductors connected to ends of the foil;

wherein the foil comprises molybdenum doped with 0.9 wt % of rhenium.

10. The lamp of claim 9, wherein the molybdenum is further doped with 0.3 wt % of $Y_2O_3$.

* * * * *